US007049566B2

(12) United States Patent
Kato et al.

(10) Patent No.: US 7,049,566 B2
(45) Date of Patent: May 23, 2006

(54) COOKING DEVICE

(75) Inventors: Hiroyuki Kato, Osaka (JP); Seiji Kanbara, Hyogo (JP)

(73) Assignee: Sharp Kabushiki Kaisha, Osaka (JP)

( * ) Notice: Subject to any disclaimer, the term of this patent is extended or adjusted under 35 U.S.C. 154(b) by 51 days.

(21) Appl. No.: 11/032,943

(22) Filed: Jan. 11, 2005

(65) Prior Publication Data

US 2005/0173422 A1 Aug. 11, 2005

(30) Foreign Application Priority Data

Jan. 15, 2004 (JP) ..... 2004-008368

(51) Int. Cl.
*H05B 6/70* (2006.01)
*H05B 6/78* (2006.01)

(52) U.S. Cl. ..... 219/746; 219/748; 219/695; 219/754

(58) Field of Classification Search ..... 219/746–751, 219/695–697, 756, 762, 754
See application file for complete search history.

(56) References Cited

U.S. PATENT DOCUMENTS 3,851,133 A * 11/1974 Dygve et al. ..... 219/749
5,742,033 A * 4/1998 Park ..... 219/746

FOREIGN PATENT DOCUMENTS

JP 56-119426 * 9/1981 ..... 219/746
JP 2002-151248 5/2002

* cited by examiner

*Primary Examiner*—Philip H. Leung
(74) *Attorney, Agent, or Firm*—Renner, Otto, Boisselle & Sklar, LLP

(57) ABSTRACT

A cooking device includes a first waveguide portion to make a microwave emitted into a heating chamber propagate radially in the directions almost parallel with the bottom face of the heating chamber and to guide the microwave propagated in the almost parallel directions into the heating chamber, and a second waveguide portion to make the microwave guided into the heating chamber by the first waveguide portion further propagate radially in directions almost parallel with the bottom face and to guide the propagated microwave into the heating chamber.

13 Claims, 5 Drawing Sheets

COOKING DEVICE

This nonprovisional application is based on Japanese Patent Application No. 2004-008368 filed with the Japan Patent Office on Jan. 15, 2004, the entire contents of which are hereby incorporated by reference.

BACKGROUND OF THE INVENTION

1. Field of the Invention

The present invention relates to a cooking device such as an electronic oven for heating an object to be heated by emitting microwaves into a heating chamber and, more particularly, to a cooking device for uniformly heating the object to be heated by uniformly emitting the microwaves into the heating chamber.

2. Description of the Background Art

Hitherto, an electronic oven A shown in FIGS. 6 and 7 is known as an example of a cooking device. FIG. 6 is a front sectional view of electronic oven A and FIG. 7 is a sectional view taken along line B—B of FIG. 6. Electronic oven A includes: a body 1; a heating chamber 2 housing objects 13-1 to 13-3 to be heated which are provided in the body 1; a cooking plate 3 made of glass, ceramics, or the like provided at a predetermined interval from the bottom face of heating chamber 2 and parallel with the bottom face; a microwave generator 4 having a magnetron provided on the outside of the body 1 and close to the body 1; a waveguide tube 5 for guiding microwaves generated from microwave generator 4 into heating chamber 2; a communication hole 10 through which waveguide tube 5 and heating chamber 2 communicate with each other; a coupling antenna 11 disposed coaxially to the center axis of communication hole 10; a flat antenna 12 made from a disc-shaped metal plate connected to the top portion on the heating chamber side of coupling antenna 11 and having plural openings; and a driving device 6 for rotating coupling antenna 11.

When a heating start switch is turned on by an operating unit (not shown) provided for the conventionally known electronic oven A, microwaves of 2,450 MHz generated by microwave generator 4 are emitted toward waveguide tube 5. The emitted microwaves are guided into heating chamber 2 via waveguide tube 5 and communication hole 10. Part of the microwaves guided into heating chamber 2 passes through a waveguide path R formed by flat antenna 12 and a bottom face 2*a* of heating chamber 2, propagates radially along the bottom face so as to be apart from communication hole 10 and, in a region after the outer peripheral portion of flat antenna 12, is guided toward the inside of heating chamber 2. Part of the microwaves guided from communication hole 10 into heating chamber 2 passes through plural openings 14 (see FIG. 7) formed in flat antenna 12 to above of flat antenna 12.

The microwaves are guided into heating chamber 2 and propagate in a wide range in such a manner, thereby irradiating objects 13-1 to 13-3 to be heated which are mounted on cooking plate 3 with microwaves and heating objects 13-1 to 13-3 to be heated.

Japanese Laid-Open Patent Publication No. 2002-151248 discloses a high-frequency heating device having a structure similar to that of electronic oven A.

SUMMARY OF THE INVENTION

In the case where the conventionally known electronic oven A or the high frequency heating device disclosed in Japanese Laid-Open Patent Publication No. 2002-151248 is used in a small space such as a kitchen in a house, a restaurant, or the like, each of electronic oven A and the high frequency heating device is formed in a shape which is not deep but is wide in order to effectively use the small space such as a kitchen. In such a wide-type electronic oven, the maximum diameter of flat antenna 12 rotating is inevitably regulated by the depth of heating chamber 2. Consequently, in the conventional electronic oven A and the high frequency heating device, although microwaves of strong energy are emitted concentratedly in the direction of the arrows Y1 shown in FIGS. 8 and 9, that is, in a space of a center portion of heating chamber 2 (portion just above flat antenna 12), the microwaves are not sufficiently emitted in a space near the side face of heating chamber 2. Even when an object to be heated which is disposed in a center portion of heating chamber 2 is heated to predetermined temperature, the object to be heated which is close to the side face of heating chamber 2 is not sufficiently heated. There is a problem such that the object to be heated cannot be uniformly heated.

The present invention, therefore, has been achieved in consideration of the circumstances and its object is to provide a cooking device capable of uniformly heating an object to be heated which is housed in a heating chamber by making microwaves uniformly radiated in the whole heating chamber.

To achieve the object, the present invention provides a cooking device including: a heating chamber which houses an object to be heated; a microwave generator to generate a microwave; and a waveguide tube to guide the microwave generated by the microwave generator into the heating chamber, an object to be heated housed in the heating chamber being heated with the microwave radiated into the heating chamber through a communication hole through which the heating chamber and the waveguide tube communicate each other, wherein the cooking device includes: a first waveguide portion to make the microwave emitted through the communication hole into the heating chamber propagate radially in the directions almost parallel with the inner face of a partition in the heating chamber having the communication hole and to guide the microwave propagated in the almost parallel directions into the heating chamber; and a second waveguide portion to make the microwave guided into the heating chamber by the first waveguide portion further propagate radially in directions almost parallel with the inner face of the partition in the heating chamber having the communication hole and to guide the propagated microwave into the heating chamber.

With the configuration, for example, the microwave emitted from the center portion of the bottom face of the heating chamber into the heating chamber is guided to the side faces of the heating chamber by the first waveguide portion and, after that, the microwave is guided by the second waveguide portion into the whole heating chamber. Thus, the object to be heated housed in the heating chamber is uniformly irradiated with the microwave. As a result, the object to be heated can be uniformly heated.

Preferably, the first waveguide portion is constructed by: a first waveguide path formed by the inner face of the partition in the heating chamber having the communication hole and a first flat plate member provided at a predetermined interval from the partition inner face and almost parallel with the partition inner face; and a second waveguide path to guide the microwave propagating through the first waveguide path into the heating chamber, and the second waveguide portion is constructed by: a third waveguide path formed by the first flat plate member and a second flat plate member which is provided on the inner side of the heating chamber than the first flat plate member and almost parallel with the partition inner face in the heating chamber having the communication hole; and a fourth waveguide path to further guide the microwave propagating through the third waveguide path into the heating chamber.

In this case, the second waveguide path may be at least one opening formed in the first flat plate member and/or an open portion provided between the outer periphery of the first flat plate member and an inner face of a partition perpendicular to the partition in the heating chamber having the communication hole.

Further, when the second waveguide path is provided over the first flat plate member apart from the center axis of the communication hole by an odd multiple of an almost quarter wavelength ($\lambda/4$) of the microwave, the microwave can travel into the heating chamber more easily and the microwave of higher energy propagates to the inside of the heating chamber. With the configuration, cooking time for the object to be heated can be shortened.

The fourth waveguide path may be at least one opening formed in the second flat plate member and/or an open portion provided between the outer periphery of the second flat plate member and an inner face of a partition perpendicular to the partition in the heating chamber having the communication hole.

In the cooking device having the structure of guiding the microwave from an opening formed in the first flat plate member to a portion below the second flat plate member (that is, the third waveguide path), by efficiently guiding the microwave propagating from the opening formed in the first flat plate member to the third waveguide path below the second flat plate member with uniform energy and emitting the microwave in the open portion on the outside of the outer periphery of the first flat plate member, heating of the object to be heated such as food can be optimized more. For the optimization, the first flat plate member has to satisfy a predetermined matching condition. The matching condition is to electrically open the outer end of the first flat plate member (to achieve maximum electric field and minimum magnetic field current). In other words, the minimum interval between the outer end of the first flat plate member and the inner face of a partition (metal border face) perpendicular to the partition in the heating chamber having the communication hole has to be an almost quarter (¼) wavelength ($\lambda/4$) of the microwave. With the configuration, the microwave with uniform energy propagates to the inside of the heating chamber and the object to be heated can be efficiently, moreover, uniformly, and optimally heated.

To make the microwave from the second waveguide path propagate to the whole heating chamber, desirably, the second flat plate member is provided almost just above the second waveguide path.

Further, two or more second flat plate members are disposed symmetrically and radially with respect to the communication hole as a center.

To make the microwave propagate into the whole heating chamber efficiently and uniformly, desirably, the cooking device further includes a rotator to rotate the second flat plate member.

Desirably, either the first flat plate member or the second flat plate member includes plural clearance maintaining members for maintaining a gap between the first and second flat plate members to be constant.

In this case, the clearance maintaining member may be a resin member having a shape projected from the top face side or the under face side in the vertical direction of either the first flat plate member or the second flat plate member, or a roller member rotatably supported by the first flat plate member or the second flat plate member.

In the cooking device, desirably, the waveguide tube guides the microwave generated by the microwave generator into the heating chamber via the communication hole formed in a bottom face of the heating chamber, the heating chamber has a cooking plate on which the object to be heated is put on the inner side of the heating chamber of the second flat plate member and, when a tip of a drive shaft of a rotator to rotate the second flat plate member is projected upward in the vertical direction from a center portion of the second flat plate member and engages with the second flat plate member, distance between the upper end of the clearance maintaining member projected from the top face side of the second flat plate member and the cooking plate is shorter than distance between the tip of the drive shaft member and the under face of the second flat plate member. With the configuration, for example, an inconvenience such that the second flat plate member disengages (comes off) from the rotator during carriage of the cooking device can be avoided.

As described above, according to the invention, a cooking device such as an electronic oven for heating an object to be heated such as food by emitting a microwave generated by a microwave generator into a heating chamber via a communication hole through which a waveguide tube and the heating chamber communicate with each other is provided with: a first waveguide portion to make the microwave emitted through the communication hole into the heating chamber propagate radially in the directions almost parallel with the inner face of a partition in the heating chamber having the communication hole and to guide the microwave propagated in the almost parallel directions into the heating chamber; and a second waveguide portion to make the microwave guided into the heating chamber by the first waveguide portion further propagate radially in directions almost parallel with the inner face of the partition in the heating chamber having the communication hole and to guide the propagated microwave into the heating chamber. Thus, the microwave can be emitted uniformly in the whole heating chamber and an object to be heated in the heating chamber can be heated uniformly.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments and examples of the present invention will be described below with reference to the attached drawings for understanding of the invention. The technical range of the invention is not limited by the following embodiments and examples.

Figure 1:
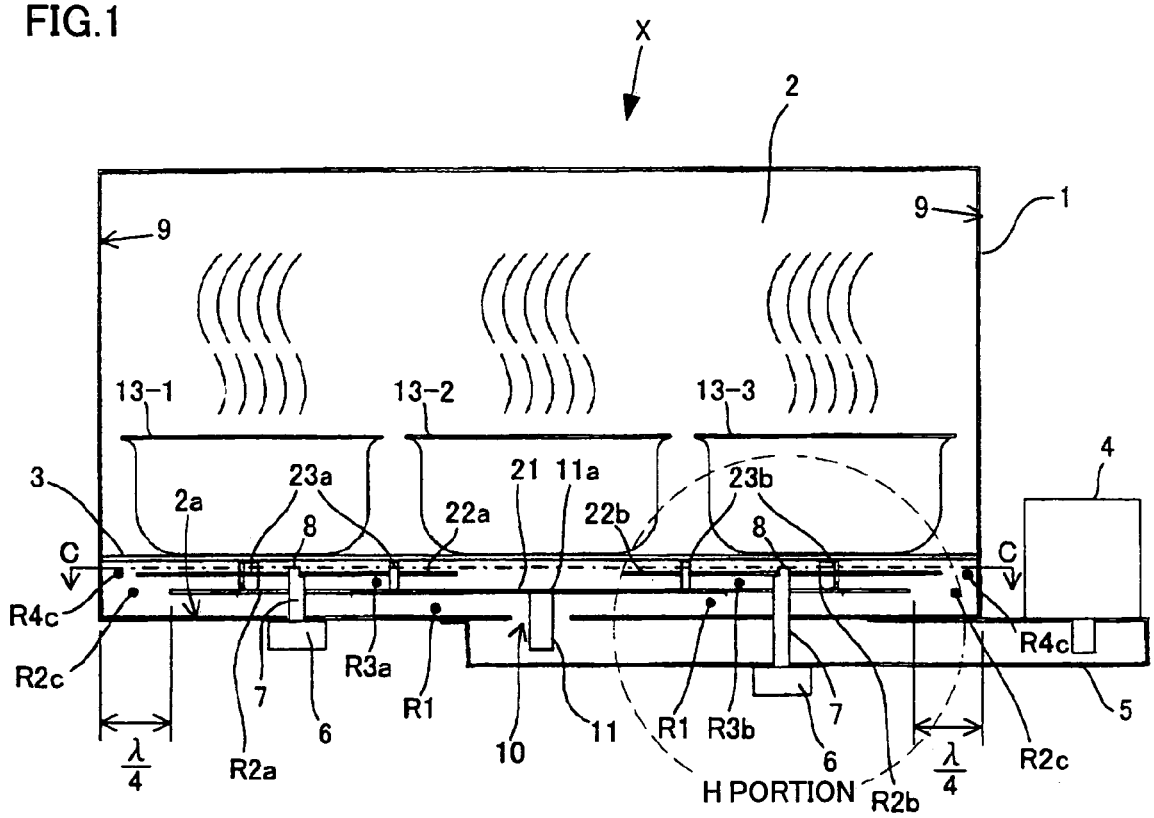
FIG. 1 is a front sectional view of an electronic oven X according to an embodiment of the invention.
Figure 2:
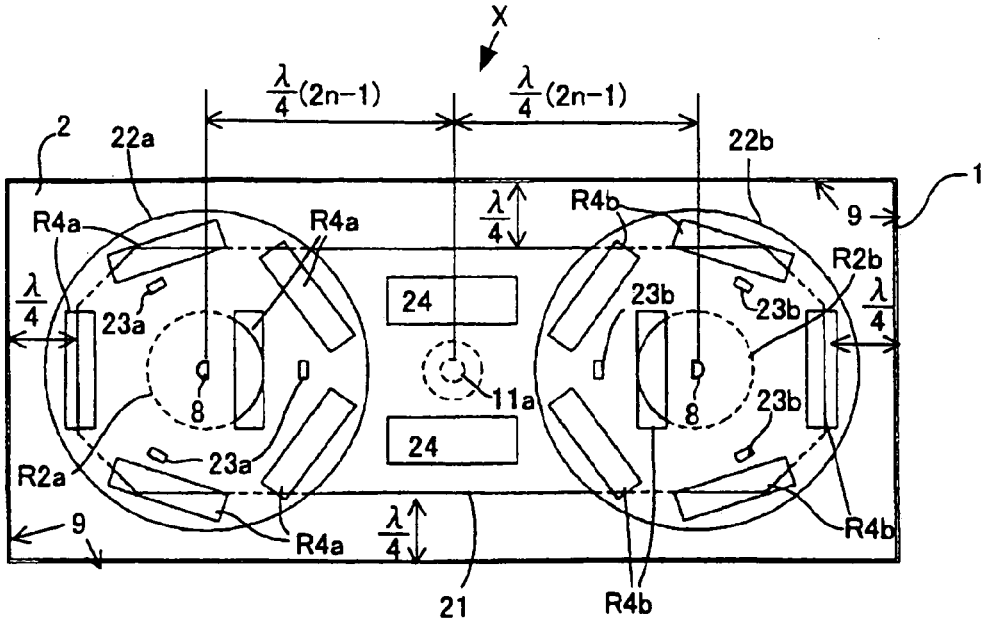
FIG. 2 is a sectional view taken along line C—C of FIG. 1.
Figure 3:
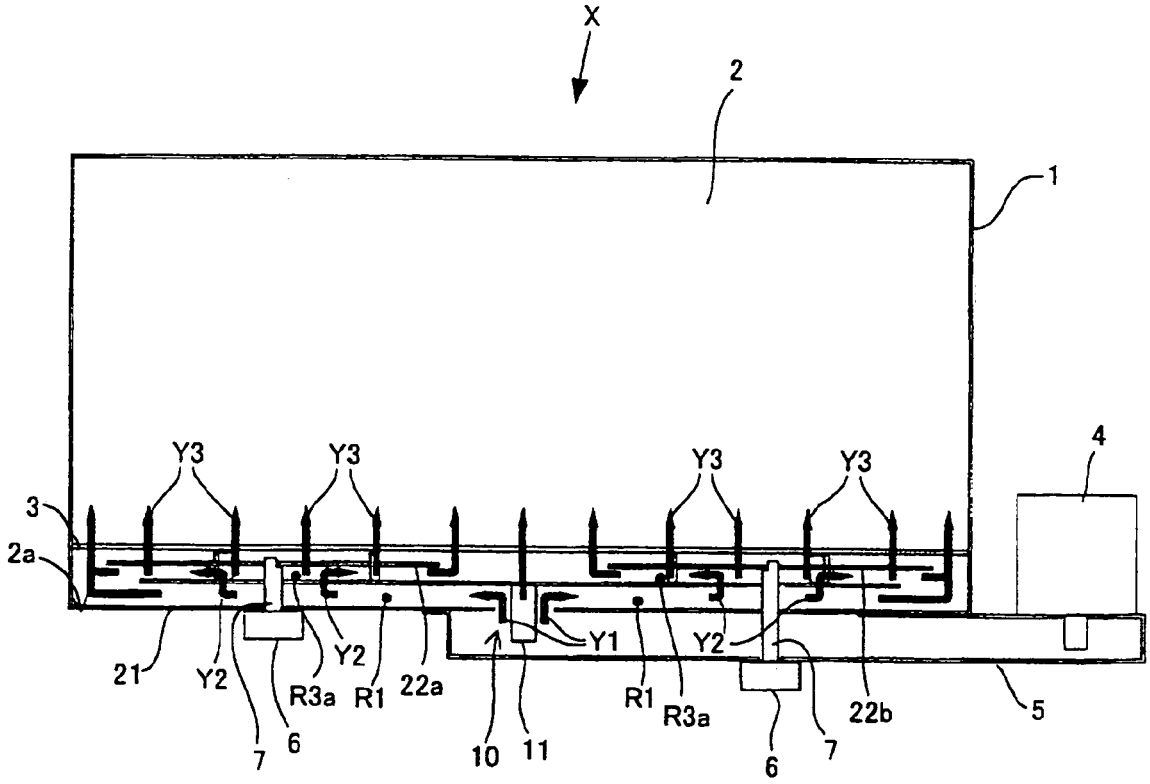
FIG. 3 is a schematic front sectional view showing propagating directions of microwaves in electronic oven X according to the embodiment of the invention.
Figure 4:
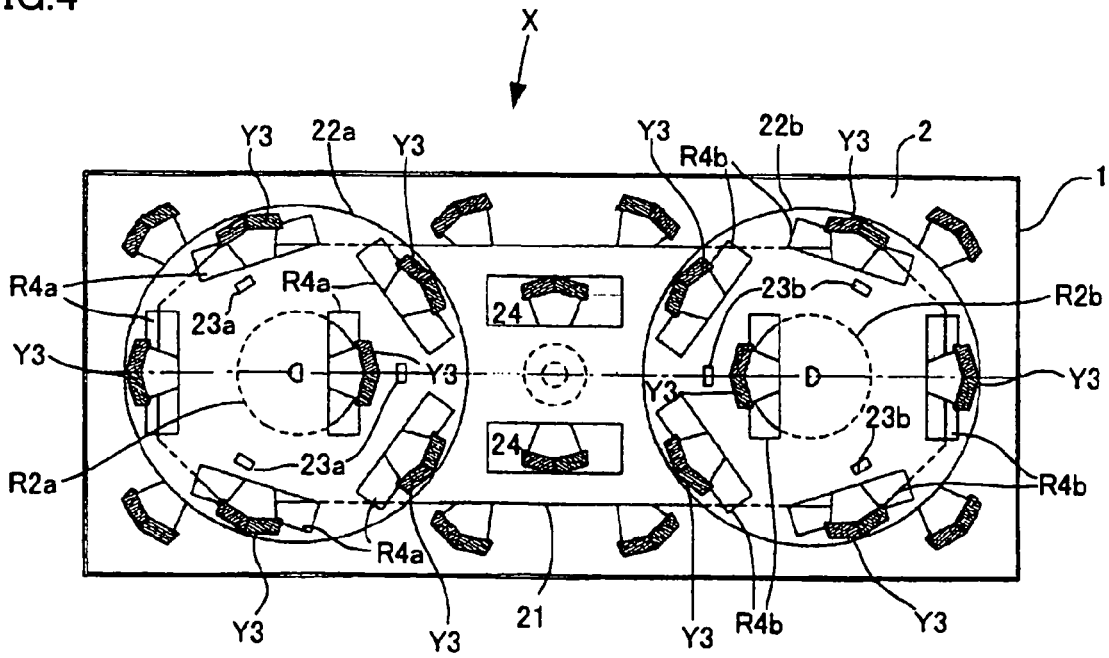
FIG. 4 is a schematic view showing the propagating directions of the microwaves in electronic oven X according to the embodiment of the invention.
Figure 5:
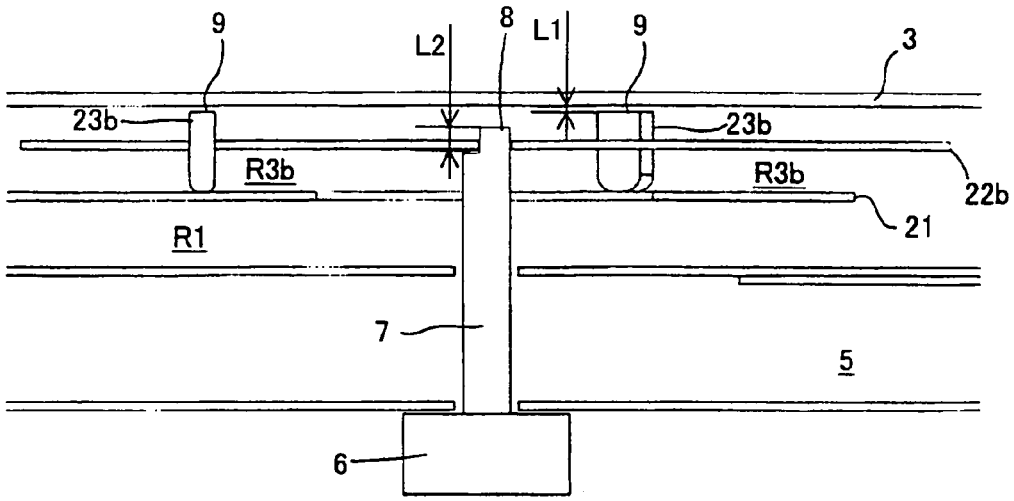
FIG. 5 is an enlarged detailed diagram of a portion H in FIG. 1.
Figure 6:
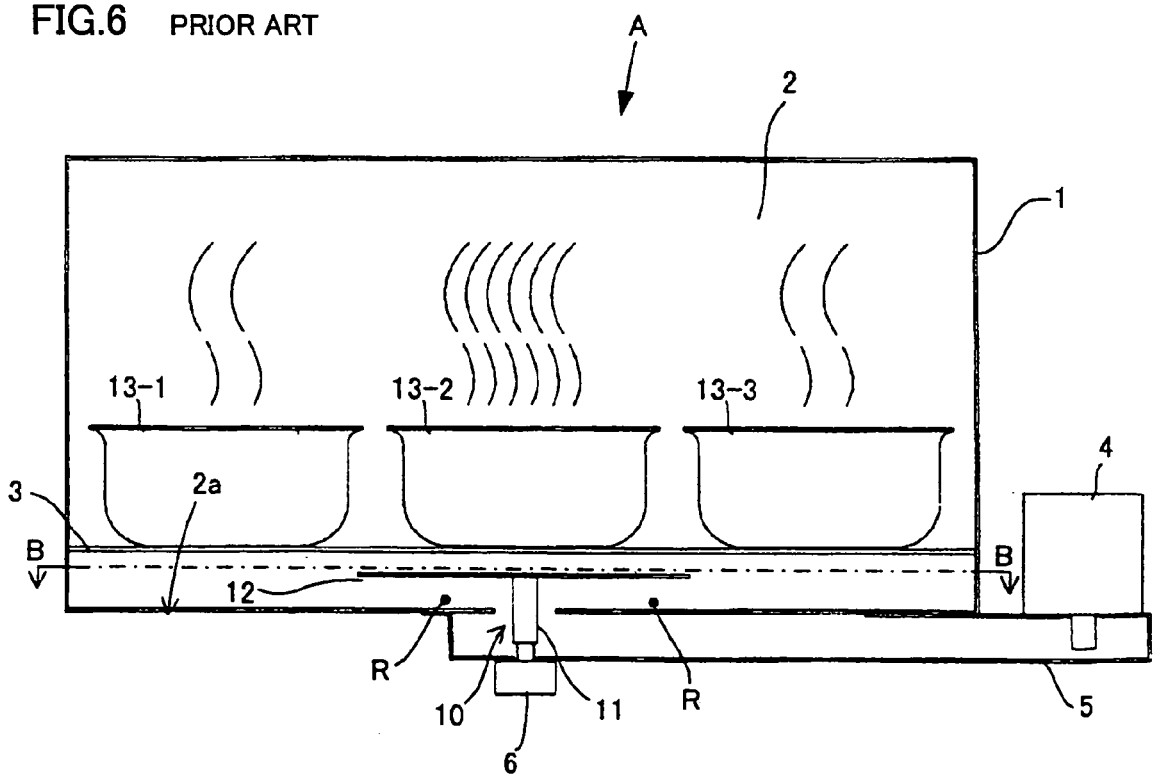
FIG.6 PRIOR ART
FIG. 6 is a front sectional view of a conventional electronic oven A.
Figure 7:
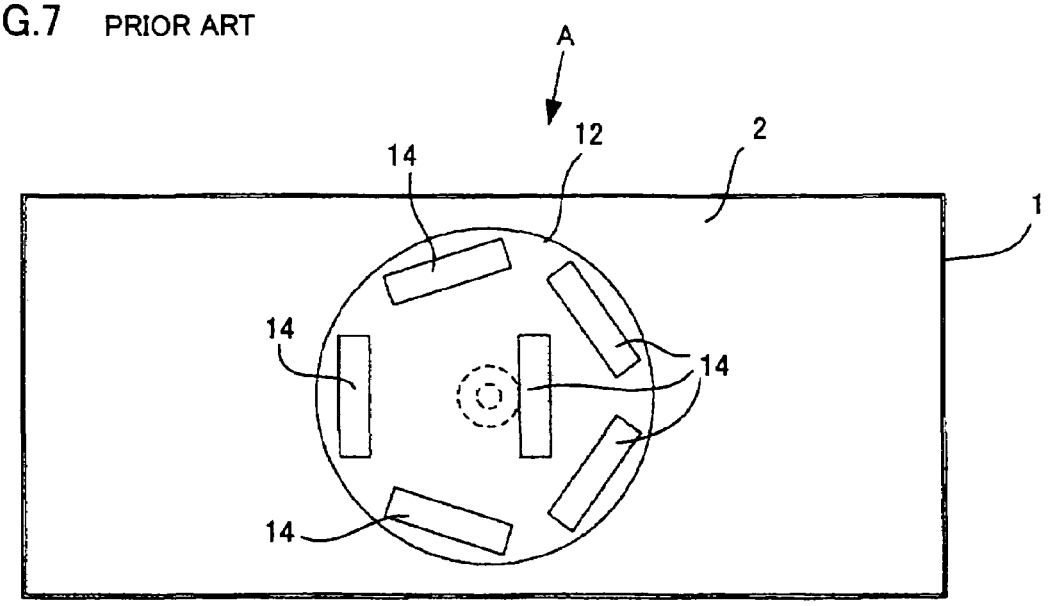
FIG.7 PRIOR ART
FIG. 7 is a sectional view taken along line B—B in FIG. 6.
Figure 8:
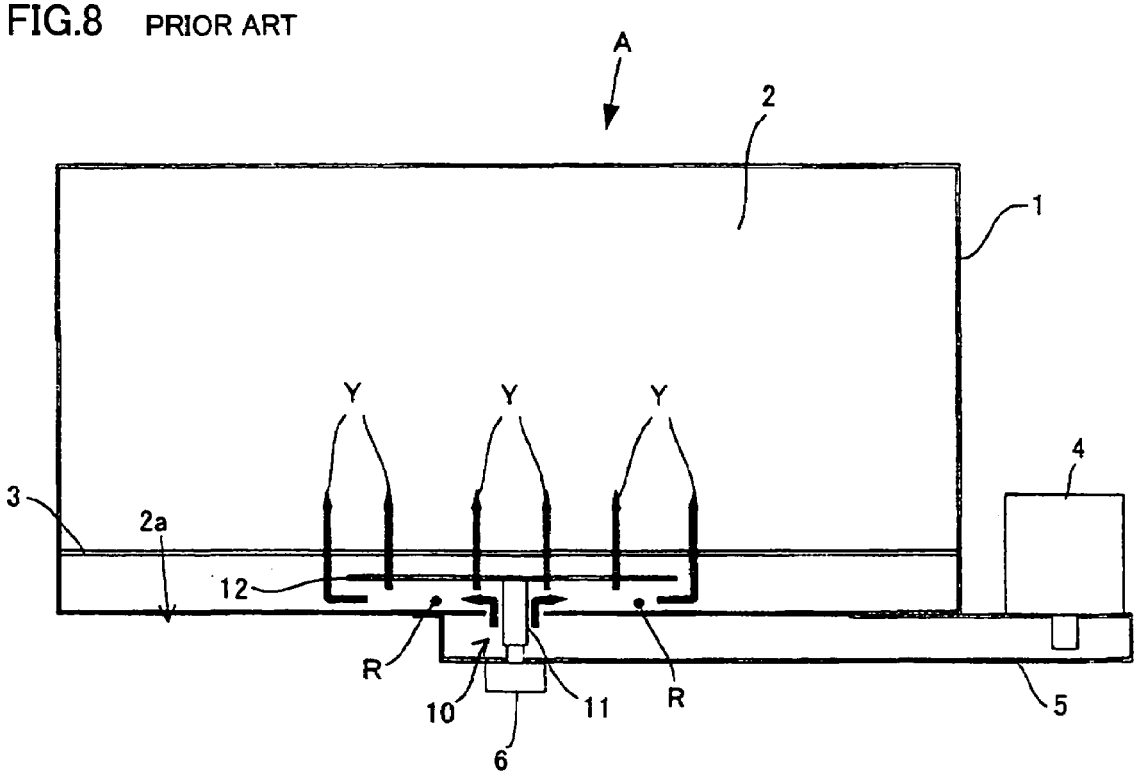
FIG.8 PRIOR ART
FIG. 8 is a schematic front sectional view showing the propagating directions of the microwaves in the conventional electronic oven A.
Figure 9:
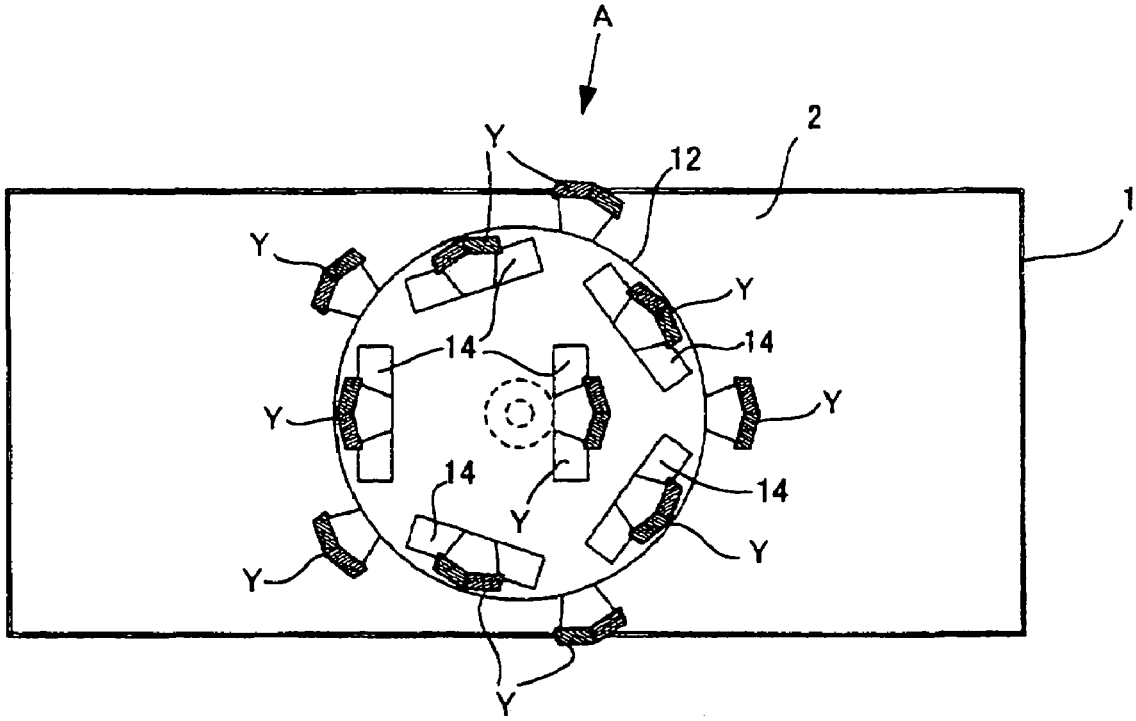
FIG.9 PRIOR ART
FIG. 9 is a conceptual diagram showing the propagating directions of the microwaves in the conventional electronic oven A.

FIG. 1 is a front sectional view of an electronic oven X according to an embodiment of the invention. FIG. 2 is a sectional view taken along line C—C of FIG. 1. FIG. 3 is a schematic front sectional view showing the propagating directions of microwaves in electronic oven X according to the embodiment of the invention. FIG. 4 is a schematic view showing the propagating directions of the microwaves in electronic oven X according to the embodiment of the invention. FIG. 5 is an enlarged detailed diagram of a portion H in FIG. 1. FIG. 6 is a front sectional view of a conventional electronic oven A. FIG. 7 is a sectional view taken along line B—B in FIG. 6. FIG. 8 is a schematic front sectional view showing the propagating directions of the microwaves in the conventional electronic oven A. FIG. 9 is a conceptual diagram showing the propagating directions of the microwaves in the conventional electronic oven A.

First, the schematic configuration of electronic oven X according to the embodiment of the invention will be described by using the front sectional view of FIG. 1. Electronic oven X is an example of a cooking device for heating an object to be heated such as food by irradiating the object to be heated with microwaves but the invention is not limited to electronic oven X.

Electronic oven X is almost the same as the conventional electronic oven A (see FIG. 8) with respect to the point that it is constructed by: a body 1; a heating chamber 2 housing objects 13 (13-1 to 13-3) to be heated which are put in the body 1; a cooking plate 3 made of glass, ceramics, or the like provided at a predetermined interval from a bottom face 2*a* of heating chamber 2 and parallel with bottom face 2*a*; a microwave generator 4 having a magnetron provided on the outside of the body 1 and close to the body 1; a waveguide tube 5 for guiding microwaves generated from microwave generator 4 into heating chamber 2; a communication hole 10 through which waveguide tube 5 and heating chamber 2 communicate each other; and a coupling antenna 11 disposed so as to be coaxial to the center axis of communication hole 10.

Electronic oven X is different from conventional electronic oven A with respect to the point that it has: a flat antenna 21 (an example of a first flat plate member) made from a wide, almost rectangular-shaped metal plate which is smaller than bottom face 2*a* of heating chamber 2 and is formed in a shape similar to bottom face 2*a*; rotary stirrers 22*a* and 22*b* (an example of a second flat plate member) made from circular-shaped metal plates supported by resin supporting members 23*a* and 23*b* (an example of a clearance maintaining member) at a predetermined interval above flat antenna 21; a waveguide path R1 (an example of a first waveguide path) formed by bottom face 2*a* and flat plate antenna 21; plural openings R2*a*, R2*b*, and 24 (an example of a second waveguide path) formed in flat antenna 21; waveguide paths R3*a* and R3*b* (an example of a third waveguide path) formed by flat antenna 21 and rotary stirrers 22*a* and 22*b*; and plural openings R4*a* and R4*b* (an example of a fourth waveguide path) formed in rotary stirrers 22*a* and 22*b*.

Flat antenna 21 is fixed to the top 11*a* on the inner side of heating chamber 2 of coupling antenna 11. Flat antenna 21 is provided almost parallel with bottom face 2*a* of heating chamber 2, having communication hole 10 (corresponding to the inner face of a partition in heating chamber 2, having communication hole 10) at a predetermined interval from bottom face 2*a*. Flat antenna 21 is supported above bottom face 2*a* at the predetermined interval by supporting members (not shown) provided around four corners of the under face (face on the side of bottom face 2*a*) of flat antenna 21. Since such flat antenna 21 is provided, waveguide path R1 sandwiched between bottom face 2*a* of heating chamber 2 and flat antenna 21 is formed. With the configuration, the microwaves emitted from waveguide tube 5 via communication hole 10 into heating chamber 2 are guided almost parallel with bottom face 2*a* and radially in the directions apart from communication hole 10.

As described above, flat antenna 21 has openings R2*a* and R2*b*. Each of openings R2*a* and R2*b* is formed in an almost circular shape around a position apart from top 11*a* of coupling antenna 11 as the center of communication hole 10 by an odd multiple (2n−1 where n denotes an integer of 1 or larger) of a wavelength of an almost quarter of the microwave ($\lambda/4$, $\lambda$ denotes the wavelength of the microwave) to each of the right and left sides (width directions of flat antenna 21). Since such openings R2*a* and R2*b* are provided in flat antenna 21, the microwave propagating through waveguide path R1 in parallel with bottom face 2*a* is guided into heating chamber 2 via openings R2*a* and R2*b*.

In addition, an open portion R2*c* having a predetermined space is provided between the outer periphery of flat antenna 21 and a side face 9 of heating chamber 2 (corresponding to the inner face of a partition perpendicular to bottom face 2*a* of heating chamber 2). Consequently, the microwave propagating through waveguide path R1 propagates into heating chamber 2 not only via openings R2*a* and R2*b* but also via open portion R2*c*. With the configuration, the microwaves can be guided to the corners of heating chamber 2. In this case, it is desirable to determine the width and the depth of flat antenna 21 so that the interval (minimum interval) between the outer periphery of flat antenna 21 and the side face of heating chamber 2 corresponds to an almost quarter (¼) wavelength of the microwave.

Rotary stirrers 22*a* and 22*b* are provided to the inner side of heating chamber 2 than flat antenna 21 and almost parallel with bottom face 2*a* of heating chamber 2 at a predetermined interval from flat antenna 21 so as to be symmetrically with respect to the communication hole as a center. Rotary stirrers 22*a* and 22*b* are supported by plural resin supporting members 23*a* and 23*b* so as to be positioned almost above openings R2*a* and R2*b*, respectively, in flat antenna 21 and so as to be rotatable in the position. Since rotary stirrers 22*a* and 22*b* are provided in such a manner, waveguide paths R3*a* and R3*b* sandwiched by flat antenna 21 and rotary stirrers 22*a* and 22*b* are formed. With the configuration, the microwave guided into heating chamber 2 via openings R2*a* and R2*b* is further guided radially via waveguide paths R3*a* and Rb3 in the direction parallel with bottom face 2*a* of heating chamber 2. Although electronic oven X having two rotary stirrers 22*a* and 22*b* will be described in the embodiment, the invention is not limited to electronic oven X. For example, an electronic oven having three or more rotary stirrers may be employed. In this case, it is desirable to dispose the rotary stirrers radially and symmetrically with respect to communication hole 10 as a center.

As described above, rotary stirrers 22*a* and 22*b* have plural openings R4*a* and R4*b* for further guiding the microwave propagating through waveguide paths R3*a* and R3*b* to the inside of heating chamber 2. Openings R4*a* and R4*b* are plural rectangular openings formed near the outer periphery and the center of rotary stirrers 22*a* and 22*b*. Since such plural openings R4*a* and R4*b* are formed in rotary stirrers 22*a* and 22*b*, the microwave propagating through waveguide path R3 is guided into heating chamber 2 via openings R4*a* and R4*b*.

In addition, an open portion R4*c* (an example of a fourth waveguide path) having a predetermined space is provided between the outer periphery of rotary stirrers 22*a* and 22*b* and side face 9 of heating chamber 2. Consequently, the microwave propagated through waveguide paths R3*a* and R3*b* uniformly propagates into heating chamber 2 via not only openings R4*a* and R4*b* but also open portion R4*c*.

On the face opposite to bottom face 2*a* just below openings R2*a* and R2*b* of electronic oven X, drive motors 6 (an example of a rotator) for rotating rotary stirrers 22*a* and 22*b* are disposed. A cylindrical drive shaft 7 of drive motor 6 penetrates bottom face 2*a* of heating chamber 2 and is inserted in heating chamber 2. A tip portion 8 of drive shaft 7 is formed in a D shape in sectional view and is fit in a D-shaped opening (not shown) formed in the center of each of rotary stirrers 22*a* and 22*b*.

With such a configuration, rotary stirrers 22*a* and 22*b* are rotated by drive motor 6, thereby enabling the microwave to be uniformly guided to the whole heating chamber.

Resin supporting members 23*a* and 23*b* for supporting rotary stirrers 22*a* and 22*b* above flat antenna 21 are fixed to rotary stirrers 22*a* and 22*b* in a state where they are projected from the top face side and the under face side in the vertical direction of rotary stirrers 22*a* and 22*b*. Resin supporting members 23*a* and 23*b* have the role of not only supporting rotary stirrers 22*a* and 22*b* above flat antenna 21 but also maintaining the clearance between flat antenna 21 and rotary stirrers 22*a* and 22*b*. Resin supporting members 23*a* and 23*b* support rotary stirrers 22*a* and 22*b* while sliding on flat antenna 21 with rotation of rotary stirrers 22*a* and 22*b*, so that the portion in contact with flat antenna 21 of each of resin supporting members 23*a* and 23*b* is formed in a shape having a curvature such as a spherical shape. Resin supporting members 23*a* and 23*b* may be replaced with other members having the same function and the same role as those of resin supporting members 23*a* and 23*b*. For example, in place of resin supporting members 23*a* and 23*b*, roller members made of a resin which are rotatably supported by rotary stirrers 22*a* and 22*b* and maintain the clearance between flat antenna 21 and rotary stirrers 22*a* and 22*b* can be also used as the clearance maintaining member. With the configuration, the frictional force generated between resin supporting members 23*a* and 23*b* and flat antenna 21 can be reduced.

As shown in FIG. 5, drive shafts 7 are fit in rotary stirrers 22*a* and 22*b* so that distance L1 between the upper end 9 of resin supporting members 23*a* and 23*b* projected from the top face side of rotary stirrers 22*a* and 22*b* and cooking plate 3 becomes shorter than distance L2 between tip portion 8 of drive shaft 7 and the under face of each of rotary stirrers 22*a* and 22*b* in the case where the tip portion 8 of drive shaft 7 of drive motor 6 for rotating rotary stirrers 22*a* and 22*b* is projected upward in the vertical direction from the center portion of each of rotary stirrers 22*a* and 22*b* and is engaged. Consequently, an inconvenience such that the tip portion 8 of drive shaft 7 is disengaged (comes off) from rotary stirrers 22*a* and 22*b* while electronic oven X is being carried can be avoided.

Waveguide path R1 and plural openings R2*a* and R2*b* are examples of the first waveguide portion making the microwave emitted from communication hole 10 into heating chamber 2 propagate radially almost parallel with bottom face 2*a* of heating chamber 2 and guiding the microwave propagating almost in the parallel directions into the heating chamber 2. Waveguide paths R3*a* and R3*b* and plural openings R4*a* and R4*b* are examples of the second waveguide portion which makes the microwave guided into heating chamber 2 by the first waveguide portion (that is, waveguide path R1 and plural openings R2*a* and Rb2) further propagate radially almost parallel with bottom face 2*a* of heating chamber 2 and guides the propagating microwave into heating chamber 2. Waveguide path R1, plural openings R2*a* and R2*b*, waveguide path R3*a* and R3*b*, and plural openings R4*a* and R4*b* are just examples of the first and second waveguide portions. As long as mechanisms or members corresponding to those are provided for electronic oven X, obviously, electronic oven X belongs to the technical range of the invention.

Since electronic oven X is provided with waveguide path R1, plural openings R2*a* and R2*b*, waveguide paths R3*a* and R3*b*, and plural openings R4*a* and R4*b*, as shown in FIGS. 3 and 4, the microwave emitted from waveguide tube 5 into heating chamber 2 propagates radially through waveguide path R1 in parallel with bottom face 2*a* of heating chamber 2 in the directions (arrows Y1) so as to be apart from communication hole 10. Subsequently, the microwave passes through openings R2*a* and R2*b* provided in flat antenna 21 (arrows Y2) and is guided to waveguide paths R3*a* and R3*b*. After that, the microwave guided into waveguide paths R3*a* and R3*b* passes through plural openings R4*a* and R4*b* formed in rotary stirrers 22*a* and 22*b* and is guided into heating chamber 2 (arrows Y3).

With the configuration, the uniform microwave propagates not only to the center portion of heating chamber 2 (portion just above flat antenna 21) but also to the corners of heating chamber 2. Consequently, not only the object 13-2 to be heated which is put in the center portion of cooking plate 3 but also objects 13-1 and 13-3 to be heated which are put on both sides of object 13-2 to be heated are sufficiently irradiated with the microwave. As a result, all of the objects to be heated in heating chamber 2 are uniformly heated.

Although electronic oven X having the mechanism for radiating the microwave from bottom face 2*a* of heating chamber 2 has been described in the foregoing embodiment, an electronic oven having the mechanism for radiating the microwave from the ceiling of heating chamber 2 may be provided with the first and second waveguide portions. Specifically, also in an electronic oven having: flat antenna 21 which is provided almost parallel with the top face in the vertical direction at a predetermined interval from the top face of heating chamber 2 having communication hole 10 and which has plural openings R2*a* and R2*b*; and rotary stirrers 22*a* and 22*b* which are provided almost parallel with the top face in the vertical direction at a predetermined clearance from flat antenna 21 on the inner side of heating chamber 2 than flat antenna 21 and have plural openings R4*a* and R4*b*, the microwave can be emitted uniformly in the whole heating chamber 2 in a manner similar to electronic oven X. Thus, an object to be heated housed in heating chamber 2 can be uniformly heated.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking device comprising:

a heating chamber which houses an object to be heated;

a microwave generator to generate a microwave; and a waveguide tube to guide said microwave generated by the microwave generator into said heating chamber, an object to be heated housed in said heating chamber being heated with said microwave radiated into said heating chamber through a communication hole through which said heating chamber and said waveguide tube communicate each other, wherein the cooking device comprises:

a first waveguide portion to make said microwave emitted through said communication hole into said heating chamber propagate radially in the directions almost parallel with the inner face of a partition in said heating chamber having said communication hole and to guide said microwave propagated in said almost parallel directions into said heating chamber prior to said microwave being propagated into a region of said heating chamber into which said object may be placed; and a second waveguide portion to make said microwave guided into said heating chamber by said first waveguide portion further propagate radially in directions almost parallel with the inner face of the partition in said heating chamber having said communication hole and to guide the propagated microwave into said heating chamber prior to said microwave being propagated into said region of said heating chamber into which said object may be placed.

2. The cooking device according to claim 1, wherein said first waveguide portion is constructed by:

a first waveguide path formed by the inner face of the partition in said heating chamber having said communication hole and a first flat plate member provided at a predetermined interval from said partition inner face and approximately parallel with said partition inner face; and a second waveguide path to guide said microwave propagating through said first waveguide path into said heating chamber, and said second waveguide portion is constructed by:

a third waveguide path formed by said first flat plate member and a second flat plate member which is provided on the inner side of said heating chamber than the first flat plate member and approximately parallel with the partition inner face in said heating chamber having said communication hole; and a fourth waveguide path to further guide said microwave propagating through said third waveguide path into said heating chamber.

3. The cooking device according to claim 2, wherein said second waveguide path is at least one opening formed in said first flat plate member and/or an open portion provided between the outer periphery of said first flat plate member and an inner face of a partition perpendicular to the partition in said heating chamber having said communication hole.

4. The cooking device according to claim 2, wherein said second waveguide path is provided over said first flat plate member apart from the center axis of said communication hole by an odd multiple of approximately a quarter wavelength ($\lambda/4$) of said microwave.

5. The cooking device according to claim 2, wherein said fourth waveguide path is at least one opening formed in said second flat plate member and/or an open portion provided between the outer periphery of said second flat plate member and an inner face of a partition perpendicular to the partition in said heating chamber having said communication hole.

6. The cooking device according to claim 2, wherein the minimum interval between the outer peripheral of said first flat plate member and the inner face of the partition perpendicular to the partition in said heating chamber having said communication hole is approximately a quarter (¼) wavelength ($\lambda/4$) of said microwave.

7. The cooking device according to claim 2, wherein said second flat plate member is provided just above said second waveguide path.

8. The cooking device according to claim 2, wherein two or more second flat plate members are disposed symmetrically and radially with respect to said communication hole as a center.

9. The cooking device according to claim 2, further comprising:

a rotator to rotate said second flat plate member.

10. The cooking device according to claim 2, wherein either said first flat plate member or said second flat plate member includes plural clearance maintaining members for maintaining a gap between said first and second flat plate members to be constant.

11. The cooking device according to claim 10, wherein said clearance maintaining member is a resin member having a shape projected from the top face side or the under face side in the vertical direction of either said first flat plate member or said second flat plate member.

12. The cooking device according to claim 10, wherein said clearance maintaining member is a roller member rotatably supported by said first flat plate member or said second flat plate member.

13. The cooking device according to claim 10, wherein said waveguide tube guides said microwave generated by said microwave generator into said heating chamber via said communication hole formed in a bottom face of said heating chamber, said heating chamber has a cooking plate on which the object to be heated is put on the inner side of said heating chamber of said second flat plate member and, when a tip of a drive shaft of a rotator to rotate said second flat plate member is projected upward in the vertical direction from a center portion of said second flat plate member and engages with said second flat plate member, distance between the upper end of said clearance maintaining member projected from the top face side of said second flat plate member and said cooking plate is shorter than distance between the tip of said drive shaft member and the under face of said second flat plate member.

* * * * *